US005912409A

United States Patent [19]

Jenkins

[11] Patent Number: 5,912,409

[45] Date of Patent: Jun. 15, 1999

[54] STAIN RESISTANCE OF NYLON CARPET

[75] Inventor: William G. Jenkins, Lexington, Va.

[73] Assignee: Burlington Industries, Inc., Greensboro, N.C.

[ * ] Notice: This patent is subject to a terminal disclaimer.

[21] Appl. No.: 08/688,042

[22] Filed: Jul. 29, 1996

Related U.S. Application Data

[63] Continuation-in-part of application No. 08/533,817, Sep. 25, 1995, Pat. No. 5,571,290, which is a continuation-in-part of application No. 08/335,951, Nov. 3, 1994, Pat. No. 5,466,527, which is a continuation of application No. 08/051,682, Apr. 23, 1993, abandoned, which is a continuation-in-part of application No. 07/787,220, Nov. 4, 1991, abandoned, which is a division of application No. 07/552,178, Jul. 12, 1990, Pat. No. 5,085,667, which is a continuation-in-part of application No. 07/519,237, May 4, 1990, abandoned.

[51] Int. Cl.[6] ..... D06P 3/06; D06P 5/08

[52] U.S. Cl. ..... 8/485; 8/445; 8/539; 8/924; 8/495; 8/615; 8/680; 8/685; 8/673

[58] Field of Search ..... 8/445, 485, 495, 8/539, 680–685, 924, 673, 615

[56] References Cited

U.S. PATENT DOCUMENTS

| | | | |
|---|---|---|---|
| 4,043,749 | 8/1977 | Huffman | 8/531 |
| 4,496,364 | 1/1985 | Stakelheck | 8/641 |
| 4,579,762 | 4/1986 | Ucci | 428/95 |
| 4,592,940 | 6/1986 | Blyth et al. | 428/96 |
| 4,693,725 | 9/1987 | Yamauchi et al. . | |
| 4,780,099 | 10/1988 | Greschler et al. . | |
| 5,085,667 | 2/1992 | Jenkins | 8/539 |
| 5,131,918 | 7/1992 | Kelley . | |
| 5,199,958 | 4/1993 | Jenkins et al. | 8/539 |
| 5,445,653 | 8/1995 | Hixson et al. . | |
| 5,466,527 | 11/1995 | Jenkins . | |
| 5,571,290 | 11/1996 | Jenkins . | |
| 5,626,632 | 5/1997 | Boyes . | |

FOREIGN PATENT DOCUMENTS

| | | |
|---|---|---|
| 1/221574 | 9/1989 | Japan . |
| 1/223908 | 9/1989 | Japan . |
| 1221574 | 9/1989 | Japan . |
| 1223908 | 9/1989 | Japan . |
| 1/072885 | 10/1989 | Japan . |
| 1/260061 | 10/1989 | Japan . |
| 1/272885 | 10/1989 | Japan . |
| 1260061 | 10/1989 | Japan . |

OTHER PUBLICATIONS

DuPont Fibers Technical Information Nylon Bulletin N–218 2/68 DuPont Nylon Styling Yarns for Carpets Feb. 1986.

*Primary Examiner*—Margaret Einsmann
*Attorney, Agent, or Firm*—Nixon & Vanderhye

[57] ABSTRACT

Stain-resistant, lightfast nylon carpet is prepared by dyeing cationic-dyeable nylon fibers by applying a print paste containing an acid dye or a premetallized acid dye at a pH of from about 2.0 to about 6–5 and fixing the dye to the fibers, forming the printed nylon fibers into a carpet, applying a print paste containing an acid dye or premetallized acid dye and dyeing the nylon fibers contacted with the print pastes and thereafter heating the dyeladen fibers to fix the dye into the fibers. Stain-resistant lightfast nylon yarns are prepared by printing cationic-dyeable yarn with a premetallized acid dye at a pH of about 4.0 to less than about 6.5 then fixing the dye to the yarn.

21 Claims, 3 Drawing Sheets

STAIN RESISTANCE OF NYLON CARPET

CROSS-REFERENCE TO RELATED APPLICATIONS

This application is a continuation-in-part of application Ser. No. 08/533,817, filed Sep. 25, 1995, now U.S. Pat. No. 5,571,290 which is a continuation-in-part of earlier application Ser. No. 08/335,951 filed Nov. 3, 1994, now U.S. Pat. No. 5,466,527, which is a continuation of Ser. No. 08/051,682 filed Apr. 23, 1993, abandoned, which is a continuation-in-part of application Ser. No. 07/787,220 filed Nov. 4, 1991, abandoned, which, is a division of application Ser. No. 07/552,178 filed Jul. 12, 1990, now U.S. Pat. No. 5,085,667, which is a continuation-in-part of earlier application Ser. No. 07/519,237 filed May 4, 1990, abandoned.

This invention relates to improving the stain resistance, lightfastness and ozone resistance of nylon, especially nylon carpet.

BACKGROUND OF THE INVENTION

Stain resistant nylon carpets enjoy significant market acceptance. Stain resistance is typically imparted to nylon by treating the fiber as a solid filament or in a carpet form by the application of a chemical finish as described in U.S. Pat. Nos. 4,501,591; 4,592,940; and 4,839,212 to Monsanto.

Nylon carpet fiber is generally classified as to type, depending upon its receptivity to acid dyes and basic or cationic dyes. Cationic dyeable nylons contain within the polymer structure sufficient $SO_3H$ groups or COOH groups (which groups are receptive to cationic or basic dyes) to render the nylon fiber dyeable with cationic dyes. Acid dyeable nylons are essentially conventional nylons, such as polyhexamethylene adipamide and polycaprolactam. Acid dyeable nylons vary as to type and are characterized as being weakly dyed with acid dyes, average dyed with acid dyes, or deeply dyed with acid dyes.

Cationic dyeable nylons generally exhibit inherent stain resistant properties, especially to acid-type stains, as compared to other nylon types used for carpet. Cationic dyeable nylons are dyeable with selected cationic dyes, but suffer from poorer lightfastness, especially in light shades, than do comparable shades dyed on acid dyeable nylon using monosulfonated or premetallized acid dyes. This has resulted in the under-utilization of cationic dyeable nylon as a carpet fiber. The fiber's inherently useful properties which otherwise make it attractive as a carpet fiber previously have not been fully realized.

BRIEF DESCRIPTION OF THE DRAWINGS

The invention is further described and illustrated in the attached drawings in which.

Figure 1:
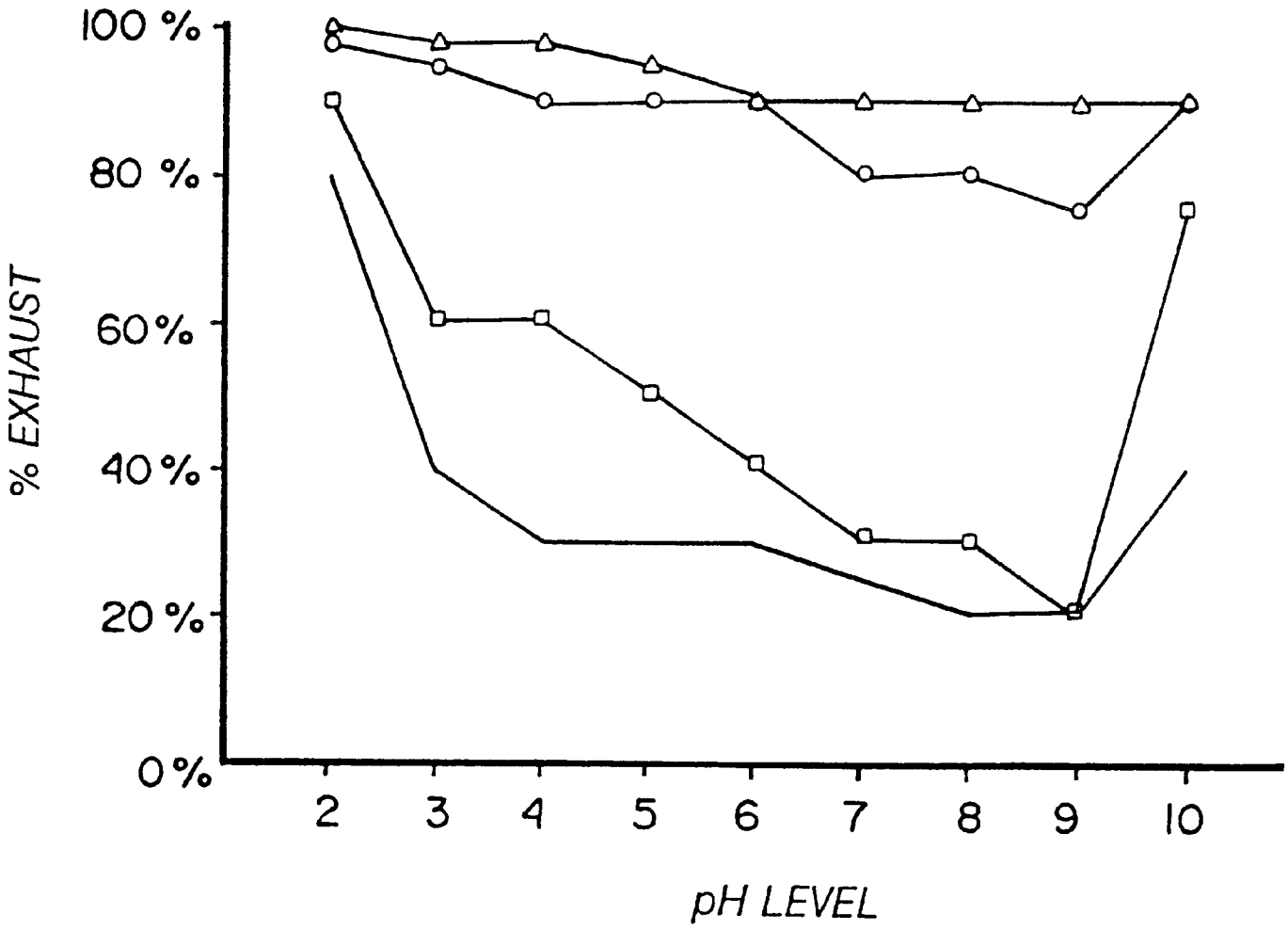
FIG. 1 is a graph plotted from the data of Tables I and II of Example 6 comparing the percent dye exhausted from a dyebath versus pH of the dyebath in dyeing filament type 634 cationic dyeable nylon (dupont) twisted into a two ply yarn then heatset to retain twist. Four types of dyebaths were compared over the pH 2–10 range; they were level acid dye (straight line), premetallized acid dye (○), level acid dye with 2% sodium sulfate (□), and premetallized acid dye with 2% sodium sulfate (Δ)
Figure 2:
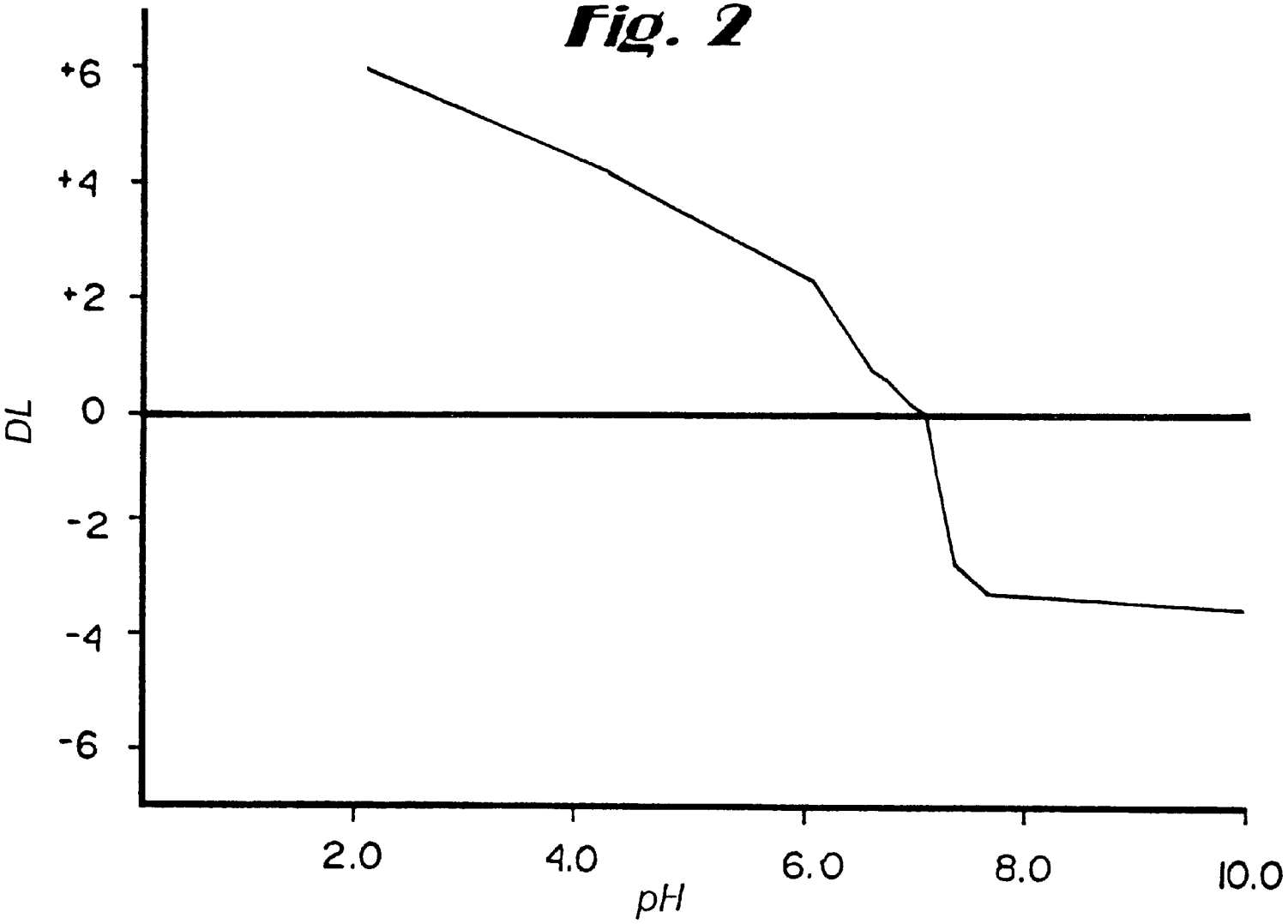
FIG. 2 is a is a graph plotted from the data of Table III of Example 7 showing the premetallized acid dyeing of 12 samples of type 494 cationic dyeable nylon (Antron, duPont) prior to heatsetting comparing lightness/darkness (Delta L*) over the pH range of 2–10.
Figure 3:
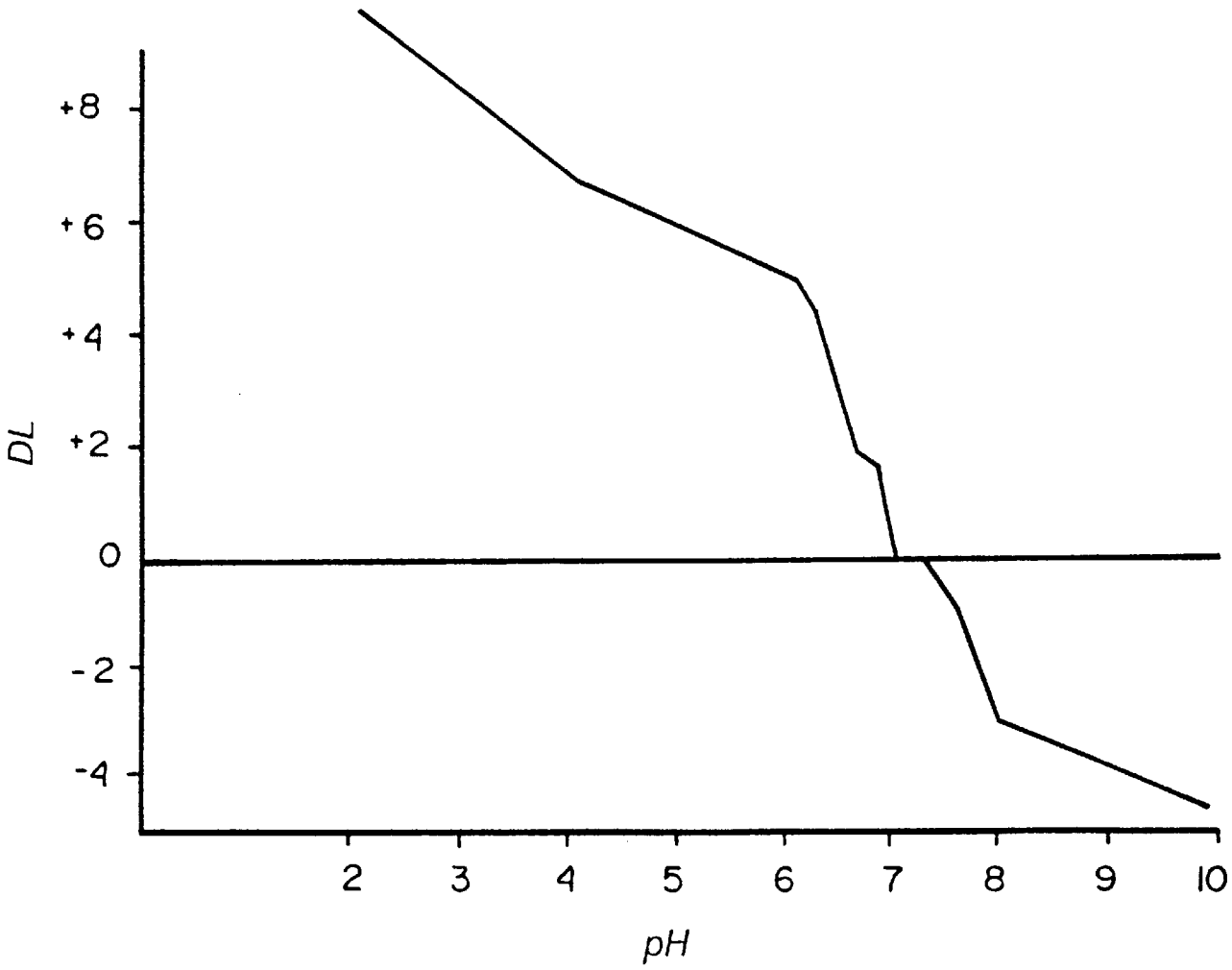
FIG. 3 is a graph plotted from the data of Table IV of Example 7 comparing the same parameters of dyeing 12 samples of the same cationic dyeable nylon prior to heatsetting using an acid dye under similar conditions.

Dyeing conditions and assessment of results are explained in more detail in Examples 6 and 7 that follow.

DESCRIPTION OF THE INVENTION

It has been found that significant differences in color yield are observed when dyeing is accomplished/ conducted at various pH levels and that significant differences appear between acid dyes and premetallized acid dyes. In general, I have observed that cationic dyeable nylon is most effectively dyed when operating in an acid pH range for both acid dyes and premetallized acid dyes with better dye exhaustion at pH values less than 7.0 than with pH values above 7.0. Efficient utilization of dye is important to process economics in using dye more effectively to reduce costs, environmentally in reducing or virtually eliminating (when possible) dye in process effluent, and repeatability of the dyeing process—the closer to complete exhaust, the more likely a repeat dyeing will look exactly the same.

My investigations reveal a sharp and significant increase in dye efficiency as the pH decreases from the neutral (pH 7) toward the acid range indicating distinctly improved results at 6.5–6.0 with improved results at lower pHs. Premetallized acid dyes provide greater dyeing efficiency, in terms of exhaustion, than do acid dyes and exhibit this characteristic over a broader range of pH values.

This invention provides a procedure for dyeing cationic dyeable nylon with acid and premetallized acid dyes over a wide range of pHs resulting in nylon carpet having improved stain resistance and fastness properties.

The preferred techniques for practicing the invention include exhaust dyeing, pad/steam dyeing, continuous carpet dyeing and the like. Illustrative examples for dyeing procedures thought to be suited to the process of this invention are:

Pad/Steam—A dyebath is prepared as follows:

The following compounds (in grams per liter) were mixed together:

| | |
|---|---|
| guar gum (Celcagum V-60) | 3 |
| antifoam (Sedgekill AO) | 1.5 |
| wetting/penetrating agent (Dyebath SS-75) | 7 |
| premetallized acid dyestuff (pH adjusted to 6.0 with monosodium phosphate) | X% |

and applied to the cationic dyeable nylon at wet pickup of 90 to 140% based on the weight of the yarn. For proper fixation, the yarn is steamed for 6 to 12 minutes and then washed, extracted, treated with a fluorochemical soil repellant and dried.

Exhaust Dyeing—an aqueous dyebath is prepared containing the required amount of premetallized acid dyestuff, the pH is adjusted to 6.0 with monosodium phosphate and, optionally, up to 0.5% Irgasol SW is added (this is a weakly cationic agent which complexes with the dye and then slowly releases the dye to the fiber as the temperature rises). The dyebath temperature, initially at 80° F., is increased at a rate of 2° F. per minute to 140° F. and held there for 15 minutes, then raised again at 2° F. per minute to 208–212° F. Cationic dyeable nylon is then exhaust dyed for 30 to 60 minutes or longer as needed to achieve the desired depth of shade. The invention also includes a process of preparing a stain-resistant, lightfast nylon carpet including the steps of: (a) dyeing cationic-dyeable nylon fibers by applying to the fibers a print paste containing an acid dye or a premetallized acid dye and optimally also sodium sulfate at a pH of from about 2.0 to about 6.5 and fixing the dye to the fibers, (b) forming the printed nylon fibers into a carpet, (c) applying to the dyed nylon carpet a print paste containing an acid dye or premetallized acid dye and optimally also sodium sulfate and dyeing the nylon fibers contacted with the print paste; and finally (d) heating the dye-laden fibers to fix the dye into the fibers. The nylon fibers may contain $SO_3H$ or COOH or both $SO_3H$ and COOH groups receptive to cationic or basic dyes in an amount sufficient to render the cationic fiber dyeable with a cationic or basic dye. The nylon fibers may be dyed at a pH of from about 4.0 to about 6.5, and subsequent to dye fixation of step (d), a fluorocarbon repellent is applied to the fibers.

Another aspect of the invention includes preparing a stain resistant, multicolored, cationic dyeable nylon yarn by first (a) applying to a cationic dyeable nylon yarn a print paste containing an acid dye at a pH of about 2.0 to less than 6.5 and fixing the acid dye to the yarn to produce a desired base shade and then (b) overprinting the dyed cationic dyeable yarn of step (a) by applying a print paste containing an acid dye or a premetallized acid dye to produce a multicolored stain-resistant nylon yarn. A stain resistant, multicolored, cationic dyeable nylon yarn may also be prepared by (a) applying to a cationic dyeable nylon yarn a print paste containing a premetallized acid dye at a pH of about 2.0 to less than 6.5 and fixing the premetallized acid dye to the yarn to produce a desired base shade, then (b) overprinting the dyed cationic dyeable yarn of step (a) by applying a print paste containing an acid dye or a premetallized acid dye to produce a multicolored stain-resistant nylon yarn.

Illustrative cationic dyeable nylons include:

| DuPont | Monsanto | Allied | BASF |
|---|---|---|---|
| Filament: | | | |
| "Antron" Type 924 | "Ultron" 2360-68-JEJ | "Anso" Type 7L422 | |
| "Antron" Type 494 | | "Anso" Type 7K53 | |
| "Antron" Type 754 | | | |
| "Antron" Type 854 | | | |
| "Antron" Type P695 | | | |
| "Antron" Type 564 | | | |
| "Antron" Type 574 | | | |
| "Antron" Type 634 | | | |
| "Antron" Type 744 | | | |
| "Antron Lumena" Type H-554A | | | |
| Solution dyed nylon Type H-544A | | | |
| Nylon Staple: | | | |
| "Antron" P-676A | "Ultron"-750-JES | "Anso" Type 591 | "Zeftron" W118S |
| "Antron" P-683A | | | |
| "Antron" 543A | | | |
| "Antron" 547A | | | |
| "Antron" 971A | | | |
| "Antron" 1055 | | | |

An affinity for cationic dyes is usually imparted by the incorporation of a monomer containing sulfonic acid groups. Thus one such modification of a polyamide fiber is obtained by adding a certain amount of sulphoisophthalic acid prior to polymerization.

Premetallized and acid dyes considered suited to the process are:

| Trade Name | Manufacturer | Color Index Name | Number |
|---|---|---|---|
| Amichrome | | | |
| Black RB | ICI | Acid Black 63 | — |
| Red RB | " | Acid Red 226 | — |
| Atalan | | | |
| Fast Orange YF | ATL | Acid Orange 69 | — |
| Orange GRE | " | Acid Orange 62 | — |
| Yellow GR | " | Acid Yellow 99 | 13900 |
| Inochrome Black BNI | ICI | Acid Black 52 | — |
| Intrachrome | | | |
| Black RPL | C & K | — | — |
| Black WA Ex Conc | " | Acid Black 52 | 15711 |
| Bordeaux RM | " | Acid Red 194 | — |
| Grey RC | " | Acid Black 127 | — |
| Orange G | " | Acid Orange 74 | — |
| Yellow GR Conc | " | Acid Yellow 99 | 13900 |
| Intralan | | | |
| Black BGL 150% | " | Acid Black 107 | — |
| Black M-RL | " | Acid Black 194 | — |
| Bordeaux M-B | " | Acid Violet 90 | — |
| Brilliant Yellow 3GL | " | Acid Yellow 127 | — |
| Dark Blue M-BR | " | — | — |
| Red Brown RW | " | — | — |
| Gray BL 200% | " | Acid Black 60 | — |
| Navy NLF | " | — | — |
| Orange RDL | " | Acid Orange 60 | 18732 |
| Yellow 2GL Extra | " | Acid Yellow 129 | — |
| Yellow GL-S | " | — | — |
| Yellow NW | " | Acid Yellow 151 | 13906 |
| Irgalan | | | |
| Black BGL | Ciba-Geigy | Acid Blk 107 | — |
| Black GBL | " | — | — |
| Black RBL | " | Acid Black 132 | — |
| Bordeaux EL | " | Acid Red 251 | — |
| Bordeaux GRL 200% | " | Acid Red 213 | — |
| Brown 2RL | " | Acid Brown 45 | — |
| Gray BL | " | Acid Black 58 | — |
| Gray BRLA | " | Acid Black 60 | — |
| Olive 3BL | " | Acid Green 70 | — |
| Orange 2RL | " | Acid Orange 60 | — |
| Orange RL | " | Acid Orange 86 | — |
| Red B 200% | " | Acid Red 182 | — |
| Red 2GL | " | Acid Red 211 | — |
| Yellow DRL | " | Acid Yellow 151 | 13906 |
| Yellow 2GL | " | Acid Yellow 129 | — |
| Irganol Brilliant Yellow 3GLS | Ciba-Geigy | Acid Yellow 127 | — |
| Isolan | | | |
| Black RL, Liq | Mobay | Acid Black 139 | — |
| Bordeaux R 220% | " | Acid Red 182 | — |
| Brown S-RL | " | Acid Brown 413 | — |
| Grey KP-BL 200 | " | — | — |
| Navy Blue S-RL | " | Acid Blue 335 | — |
| Red S-RL | " | Acid Red 414 | — |
| Yellow K-PRL 200% | " | Acid Yellow 137 | — |
| Yellow NW 250% | " | Acid Yellow 151 | 13906 |
| Yellow S-GL | " | Acid Yellow 232 | — |
| Lanaperl | | | |
| Blue GN 200 | Hoechst | Acid Blue 41 | — |
| Blue GN | " | Acid Blue 40 | 62125 |
| Fast Navy Blue R 200 | " | Acid Blue 113 | — |
| Turquoise Blue GL | " | — | — |
| Lanasyn | | | |
| Black BGL 200% | Sandoz | Acid Black 131 | — |
| Black BRL 200% | " | Acid Black 132 | — |
| Black S-DL, Liq | " | Acid Black 194 | — |
| Black S-GL, Liq | " | Acid Black 222 | — |
| Black S-RL, Liq | " | Acid Black 218 | — |
| Bordeaux GRL | " | Acid Red 213 | — |
| Bordeaux RL | " | Acid Red 217 | — |

-continued

| Trade Name | Manufacturer | Color Index Name | Number |
|---|---|---|---|
| Brown 2GL | " | Acid Brown 304 | — |
| Carbon BL | | Acid Black 170 | — |
| Dark Brown S-BL | " | Acid Brown 289 | — |
| Dark Brown S-GL | " | Acid Brown 298 | — |
| Grey BL | " | Acid Black 58 | — |
| Grey BLR | " | Acid Black 60 | 18165 |
| Navy S-BL, Liq | " | Acid Blue 296 | — |
| Navy S-DNL | " | — | — |
| Olive Green S-4GL | " | Acid Green 106 | — |
| Olive S-2GL | " | Acid Green 106 | — |
| Orange S-RL | " | Acid Orange 168 | — |
| Red 2GLN | " | Acid Red 404 | — |
| Red S-G, Liq | " | Acid Red 399 | — |
| Rubine S-5BL | " | Acid Violet 125 | — |
| Yellow LNW | " | Acid Yellow 151 | 13906 |
| Yellow 2RL | " | Acid Orange 80 | — |
| Yellow S-2GL, Liq | " | Acid Yellow 235 | — |
| Levalan | | | |
| Brown I-BRL Cold SOL | Mobay | Acid Brown 330 | — |
| Dark Brown I-TL | " | Acid Brown 331 | — |
| Neolan | | | |
| Black WA | Ciba-Geigy | Acid Black 52 | 15711 |
| Blue 2G Conc | " | Acid Blue 158 | 14880 |
| Bordeaux RM 133% | " | Acid Red 194 | — |
| Orange G | " | Acid Orange 74 | 18745 |
| Pink BNA 300% | " | Acid Red 186 | 18810 |
| Yellow GR | " | Acid Yellow 99 | 13900 |
| Neutrichrome | | | |
| M Black M-R | ICI | Acid Black 194 | — |
| M Bordeaux M-B | " | Acid Violet 90 | 18762 |
| M Navy M-BD | " | — | — |
| M Yellow M-3R | " | Acid Brown 384 | — |
| Neutrichrome | | | |
| S Black S-2B | " | Acid Black 224 | — |
| S Bordeaux S-BD | " | Acid Violet 121 | — |
| S Brown S-2R | " | Acid Brown 357 | — |
| S Grey S-BG | " | Acid Black 188 | — |
| S Navy S-B | " | Acid Blue 284 | — |
| S Navy S-NA | " | — | — |
| S Orange S-R | " | Acid Orange 144 | — |
| S Red S-G | " | Acid Red 359 | — |
| S Yellow S-GR | " | Acid Yellow 121 | 19690 |
| S Yellow S-5R | " | Acid Orange 120 | — |
| Orcolan | | | |
| Fast Black WAN Ex | ORC | Acid Black 52 | 15711 |
| Fast Blue GGN | " | Acid Blue 158 | 15050 |
| Fast Orange GEN | " | Acid Orange 74 | 18745 |
| Fast Orange GLE-S | " | Acid Orange 62 | — |
| Fast Red RN | " | Acid Red 183 | — |
| Fast Yellow BELN | " | Acid Yellow 54 | 19010 |
| Fast Yellow GRN | " | Acid Yellow 99 | 13900 |
| Neutral Black BGL | " | Acid Black 107 | — |
| Neutral Black BR | " | Acid Black 194 | — |
| Neutral Black EKC Ex Conc | " | Acid Black 164 | — |
| Neutral Black LDS | " | — | — |
| Neutral Blue GL | " | Acid Bue 127 | 61135 |
| Neutral Bordeaux BSB | " | Acid Violet 90 | 18762 |
| Neutral Brilliant Yellow 5G | " | Acid Yellow 127 | — |
| Neutral Brown BRL | " | — | — |
| Neutral Brown 2GL | " | Acid Brown 44 | — |
| Neutral Brown GRS | " | Acid Brown 282 | — |
| Neutral Brown 2RL | " | Acid Brown 45 | — |
| Neutral Dark Blue BR | " | Acid Blue 193 | 15707 |
| Neutral Grey B | " | Acid Black 60 | — |
| Neutral Grey BLGY-N | " | Acid Black 58 | — |
| Neutral Orange NR | " | Acid Orange 60 | — |
| Neutral Orange RL 250% | " | Acid Orange 86 | — |
| Neutral Red B | " | Acid Red 182 | — |
| Neutral Yellow EKL | ORC | Acid Yellow 121 | — |

-continued

| Trade Name | Manufacturer | Color Index Name | Number |
|---|---|---|---|
| Ex Conc | | | |
| Neutral Yellow 2GL Ex | " | Acid Yellow 129 | — |
| Neutral Yellow GLSN | " | Acid Yellow 114 | — |
| Neutral Yellow WN 250% | " | Acid Yellow 151 | — |
| The following level dyeing acid dyes are thought to work particularly in the light depths but do not build very well as strength is increased: | | | |
| Nylanthrene | | | |
| Black GLRT | C & K | — | — |
| Black GLWC | " | — | — |
| Blue B-AR 67% Liq | " | — | — |
| Blue B-AR 200% | " | — | — |
| Blue B-GA | " | — | — |
| Blue B-NB | " | — | — |
| Blue GLF | " | — | — |
| Blue LGGL | " | — | — |
| Brilliant Blue 3BLF | " | — | — |
| Brilliant Blue 2RFF | " | — | — |
| Brilliant Yellow 4NGL | " | Acid Yellow 49 | — |
| Brilliant Yellow B-NGL | " | — | — |
| Brilliant Yellow B-4RK | " | Acid Yellow 219:1 | — |
| Brilliant Yellow CGL p.a.f. | " | — | — |
| Brown RSM | " | — | — |
| Navy LFWG | " | — | — |
| Orange B-GN | " | — | — |
| Orange 3G | " | Acid Orange 156 | — |
| Orange SLF Conc | " | Acid Orange 116 | — |
| Pink BLRF (pat) | " | — | — |
| Red B-2B | " | — | — |
| Red B-2BSA | " | Acid Red 266 | — |
| Red B-CLN Conc | " | — | — |
| Red 2RDF | " | — | — |
| Red 4RL (pat) | " | — | — |
| Rubine 5BLF | " | Acid Red 299 | — |
| Scarlet B-YKS | " | — | — |
| Scarlet GYL Ex (pat) | " | — | — |
| Scarlet YDL p.a.f. | " | — | — |
| Yellow FLW | " | Acid Yellow 159 | — |
| Yellow RAR Liq | " | Acid Yellow 152 | — |
| Yellow SL 200% | " | Acid Yellow 198 | — |
| Yellow SL Liq | " | Acid Yellow 198 | — |
| Nylomine | | | |
| Black D-2R | ICI | Acid Black 172 | — |
| Blue A-G Conc Grains | " | Acid Blue 25 | 62055 |
| Blue A-2R | " | Acid Blue 62 | 62045 |
| Blue B-3G | " | Acid Blue 40 | 62125 |
| Blue C-B | " | Acid Blue 127:1 | — |
| Blue C-2G | " | Acid Blue 175 | — |
| Blue C-3R | " | Acid Blue 140 | — |
| Bordeaux C-B | " | Acid Red 128 | 24125 |
| Bordeaux C-3B | | Acid Red 119 | — |
| Green C-G | " | Acid Green 27 | 61580 |
| Green C-3G | " | Acid Green 28 | — |
| Navy C-2R | " | Acid Blue 113 | 26360 |
| Red A-B | " | Acid Red 396 | — |
| Red A-2B 100% | " | Acid Red 266 | — |
| Red B-3B | " | Acid Red 57 | — |
| Red C-2B | " | Acid Red 138 | 18073 |
| Red C-BA | " | Acid Red 249 | 18134 |
| Red C-G | " | Acid Red 151 | — |
| Violet C-B | " | Acid Violet 48 | — |
| Yellow A-G | " | Acid Yellow 135 | — |
| Yellow A-G 33% Pst | " | Acid Yellow 135 | — |
| Yellow A-2GA 200% | " | Acid Yellow 49 | — |
| Yellow A-4R 150 | " | Acid Yellow 199 | — |
| Nylosan | | | |
| Blue 2AL/C-2AL | Sandoz | Acid Blue 25 | 62055 |
| Blue E/C-BGL 200% | " | — | — |
| Blue E/C-BRL | " | Acid Blue 288 | — |

-continued

| Trade Name | Manufacturer | Color Index Name | Number |
|---|---|---|---|
| Blue E/C-GL | " | Acid Blue 72 | — |
| Blue F-GBL | " | Acid Blue 127:1 | — |
| Blue F-L | " | Acid Blue 80 | 61585 |
| Blue F-RL | " | Acid Blue 247 | — |
| Blue N-BLN | " | — | — |
| Blue N-5GL 200% | " | Acid Blue 280 | — |
| Blue PRL | " | Acid Blue 129 | — |
| Bordeaux E-2BL | " | Acid Red 301 | — |
| Bordeaux N-BL | | Acid Red 119 | — |
| Brilliant Blue N-FL | " | Acid Blue 278 | — |
| Brilliant Green F-6GL | " | Acid Green 28 | — |
| Brown N-2R | " | Acid Orange 51 | 26550 |
| Green F-BL, 200% | " | Acid Green 40 | — |
| Navy N-RBL Conc | " | Acid Blue 113 | 26360 |
| Orange C-GNS/E-GNS Pat | " | Acid Orange 156 | — |
| Orange E-2GL | " | Mord Orange 6 | 26520 |
| Orange N-RL | " | Acid Orange 127 | — |
| Red E-BM | " | — | — |
| Red F-5B | " | Acid Red 143 | — |
| Red F-BR | " | Acid Red 167 | — |
| Red F-2R/C-2R | " | Acid Red 151 | 26900 |
| Red F-RL | " | Acid Red 263 | — |
| Red F-RS, Conc | " | Acid Red 114 | 23635 |
| Red N-2RBL | Sandoz | Acid Red 336 | — |
| Rubine N-5BL, 200% | " | Acid Red 299 | — |
| Scarlet F-3GL | " | Acid Red 111 | 23266 |
| Violet F-BL | " | Acid Violet 48 | — |
| Yellow N-7GL | " | Acid Yellow 218 | — |
| Yellow N-3RL | " | Acid Orange 67 | — |
| Tectilon | | | |
| Black GD | Ciba-Geigy | — | — |
| Blue 4GN | " | Acid Blue 343 | — |
| Blue GRL | " | Acid Blue 25 | 62055 |
| Blue 5GS | " | — | — |
| Blue 4R | " | Acid Blue 277 | — |
| Floxine KL 220% | " | Acid Red 257 | — |
| Orange 3G | " | Acid Orange 156 | — |
| Orange 3R | " | — | — |
| Orange 4R | " | — | — |
| Red 2B | " | Acid Red 361 | — |
| Red GR | " | Acid Red 73 | 27290 |
| Yellow 2G | " | Acid Yellow 169 | — |
| Yellow 4R | " | Acid Yellow 219 | — |
| Telon | | | |
| Blue ANL | Mobay | Acid Blue 25 | 62055 |
| Blue ANL Liq 33 | " | Acid Blue 25 | — |
| Blue BL 125 | " | Acid Blue 78 | 62105 |
| Blue BRL 200 | " | Acid Blue 324 | — |
| Blue BRL Disp 67 | " | Acid Blue 324 | — |
| Blue BRL Liq 67 | " | Acid Blue 324 | — |
| Blue CD-FG | " | Acid Blue 145 | 23905 |
| Blue 2GL 200 | " | Acid Blue 40 | 62125 |
| Blue 2GL Disp 50 | " | Acid Blue 40 | 62125 |
| Blue 4GL | " | — | — |
| Blue RRL 182 | " | Acid Blue 62 | 62045 |
| Fast Black LD | " | Acid Black 172 | — |
| Fast Black LG Liq 40 | " | — | — |
| Fast Black NW | " | — | — |
| Fast Blue A-FN | " | Acid Blue 264 | — |
| Fast Blue A-3GL | " | Acid Blue 290 | — |
| Fast Blue A-RW | " | Acid Blue 205 | — |
| Fast Blue ESN | " | Acid Blue 221 | — |
| Fast Blue 5G | " | Acid Blue 232 | — |
| Fast Blue GL 200 | " | Acid Blue 102 | 50320 |
| Fast Blue GGN | " | Acid Blue 127:1 | — |
| Fast Blue RLW | " | Acid Blue 204 | — |
| Fast Green BW | " | Acid Green 84 | — |
| Fast Navy Blue R 182 | " | Acid Blue 113 | 26360 |
| Fast Navy Blue RF | " | Acid Blue 113 | 26360 |
| Fast Orange A-RTL 200 | " | Acid Orange 116 | — |
| Fast Red A-FG | " | Acid Red 360 | — |
| Fast Red BRL 200 | " | Acid Red 260 | — |
| Fast Red 3BW | " | Acid Red 274 | — |
| Fast Red ER | " | Acid Red 158 | 20530 |

-continued

| Trade Name | Manufacturer | Color Index Name | Number |
|---|---|---|---|
| Fast Red GN | Mobay | Acid Red 111 | 23266 |
| Fast Rubine A5BL 167 | " | — | — |
| Fast Rubine A-5BLW | " | Acid Red 299 | — |
| Fast Violet A-BB | " | Acid Violet 103 | — |
| Fast Yellow A-3GL | " | Acid Yellow 216 | — |
| Fast Yellow A-3RL | " | — | — |
| Fast Yellow 4GL 175 | | Acid Yellow 79 | — |
| Red 2BL 200 | " | Acid Red 266 | — |
| Red 2BL Liq 33 | " | Acid Red 266 | — |
| Red 2BL Disp 67 | " | Acid Red 266 | — |
| Red BR-CL Disp 83 | " | — | — |
| Red BR-CL 250 | " | — | — |
| Red CD-R | " | Acid Red 395 | — |
| Red FL 200 | " | Acid Red 337 | — |
| Red FL Liq 33 | " | Acid Red 337 | — |
| Red FL Disp 67 | " | Acid Red 337 | — |
| Yellow FGL 200 | " | Acid Yellow 49 | — |
| Yellow FGL Liq 66 | " | Acid Yellow 49 | — |
| Yellow K-RNL 200 | " | Acid Yellow 230 | — |
| Yellow Brown 3GL | " | Acid Brown 248 | — |

The tests employed in the examples that follow are identified by their AATCC or other monograph designations and are briefly described as follows:

Test 1. AATCC Test Method 175, 1992—A solution of eight milligrams FD&C Red Dye No. 40 per liter of distilled water is prepared with pH of the solution adjusted to 5.5 with citric acid. The temperature of this solution is maintained at 75° F.±5° F.

The carpet sample to be tested is placed on a flat surface, and an approximately two inch diameter cylinder (open on both ends) is placed onto the surface of the carpet. Twenty ml. of the above test solution is poured into this cylinder and allowed to absorb into the carpet, after which the cylinder is removed. The carpet is allowed to stand with the stain on it undisturbed for 24 hours. After 24 hours, the carpet is thoroughly flush rinsed under cold or cool tap water, then extracted and either dried in an oven or air dried.

The degree of staining is judged by comparing the amount of discoloration produced in the spotted area as compared to the surrounding area. The Modified Allied Stain Resistance Scale, a 10 point transparency scale, is used to provide a numerical rating. For the purpose of these studies, more interest was given to the relative staining differences between carpet samples.

Test 2. B-1—DuPont Blue Dye 1 "Stainmaster" Test—A solution is prepared the same as in the above test except eight milligrams of FD&C Blue Dye 1 is used; the test is carried out in the identical manner as the AATCC stain test just described.

Test 3. A-40—DuPont Red Dye 40 "Stainmaster" Test—A solution of 45 grams of cherry flavored "Kool-Aid" (sweetened) in 500 ml of distilled water is prepared. The solution is maintained at 75° F.±5° F. Spotting, washing, etc., is. conducted the same as that described above.

In the following examples cationic dyeable filament yarn (dupont type 494) which was not heatset was dyed across a range of different pH values (2.0–10.0) by adjusting the pH to the desired level with phosphoric acid, monosodium phosphate or tetrasodium phosphate.

The invention is further explained with reference to the following illustrative examples. All parts and percentages are by weight unless otherwise indicated.

EXAMPLE 1

A sample carpet was made using type 854 cationic dyeable Antron dyed in two shades, air entangled into a 4-ply yarn, then tufted into a level loop carpet swatch.

The following dyebaths were used:

| | Beige | Gray |
|---|---|---|
| Irgalan Yellow 3RL 200% | .072% | .0247% |
| Irgalan Bordeaux EL 200% | .0211% | .0045% |
| Irgalan Black GBL 200% | .05% | .0448% |

Percentages (%) are based upon weight of dye to weight of fiber. Each dyebath was adjusted to pH 6 with 0.2% monosodium phosphate (MSP).

Antron. The type 855 yarn was only appreciably darker at the 1.0% level, indicating the ability to dye light to medium shades on type 854 Antron cationic dyeable nylon with premetallized acid dyes.

EXAMPLE 3

Lightfastness and ozone resistance were tested on the twelve representative shades of premetallized acid dyes on cationic dyeable Antron type 854 nylon.

The dye constituents used to prepare the shades were as follows:

| | Lt Gold | Beige | Green | Blue | Rose Beige | Dusty Rose | Rust | Burgundy | Black | Med Gray | Green Gray | Lt Blue |
|---|---|---|---|---|---|---|---|---|---|---|---|---|
| Irgalan Yellow 3RL 200% (Acid Orange 162) | .16% | .12% | .17% | .012% | .148% | .0115% | | | | .02% | .074% | .022% |
| Irgalan Red Brown RL 200% (Acid Brown 226) | .029% | .029% | | | | .288% | 1.0% | | | | .018% | |
| Irgalan Bordeaux EL 200% (Acid Red 251) | | | | | .08% | | | 1.0% | | | | .007% |
| Irgalan Blue 3GL 200% (Acid Blue 171) | .016% | .02% | | .288% | .064% | | | | | | .16% | .076% |
| Irganol Brilliant Blue 7GS 200% (Acid Blue 239) | | | .25% | | | | | | | | | |
| Irgalan Black RBL 200% (Acid Black 132) | | | | | | | | | 1.0% | .20% | | |

% dyestuff based upon the weight of the fiber
2.0% Monosodium Phosphate pH 6.0

For performance comparisons, two previously dyed yarns of type 856/857 Antron (acid dyeable) of the same shade were each tufted into carpet swatches. As a control a third pair of carpet swatches was prepared from DuPont's solution dyed Antron Lumena, two ends each of light grey and smoke beige.

The three sets of samples were subjected to each of Tests 1, 2 and 3 according to the test procedure identified above. The two acid dyeable Antron samples performed poorly for stain resistance, whereas the cationic-dyeable Antron 854 dyed with premetallized acid dyes according to the present invention and Antron Lumena performed very well for stain resistance in all three tests with no residual stain after washing with cold clear water and extracting.

EXAMPLE 2

Cationic dyeable Antron 854 knitted sock was dyed with the following premetallized acid dyes at concentrations of 0.05, 0.1, 0.25 and 1.0%:

| | |
|---|---|
| Irgalan Bordeaux EL | 200% |
| Irgalan Yellow 3RL-KWL | 250% |
| Irgalan Red Brown RL | 200% |
| Irgalan Blue 3GL | 200% |
| Irgalan Black RBL | 200% |
| Irganol Brilliant Blue 7GS | 200% |

at pH 6.0 adjusted with MSP. No other additives were used in the aqueous dyebath.

To determine the ability to build the depth of shade, a similar dyeing was made on type 855 light acid dyeable

| | Lightfastness* | | AATCC-Ozone |
|---|---|---|---|
| Shade | 120 hrs | 200 hrs | 5 cycle |
| light gold | 4/5 | 3/4 | 3/4 |
| beige | 4/5 | 4 | 3/4 |
| green | 4/5 | 3 | 3 |
| blue | 4/5 | 4 | 3 |
| rose beige | 4/5 | 4/5 | 3 |
| dusty rose | 5 | 4 | 3/4 |
| rust | 5 | 5 | 4 |
| burgundy | 5 | 4/5 | 3/4 |
| black | 4/5 | 4/5 | 3/4 |
| medium gray | 5 | 4/5 | 3 |
| green gray | 4/5 | 3/4 | 3 |
| light blue | 4/5 | 3/4 | 2/3 |

*AATCC 16E

The level of lightfastness achieved performs very well under the most severe exposure conditions such as those found in direct sunlight or behind glass. In contrast, the cationic dyes began to perform poorly after only 40 hours. A grade of 3 or better after 5 cycles of ozone is accepted by the industry in tropical climates in un-airconditioned installations.

EXAMPLE 4

Traffic performance was evaluated using a commercial carpet construction in a two-tone gray color. Three fibers were selected:

| Name | Type |
|---|---|
| Antron T-854 | cationic dyeable |
| Antron Lumena | solution dyed |
| Antron T-857 | acid dyeable |

The cationic dyeable nylon was dyed with the following premetallized dyes:

Red Grey

| | |
|---|---|
| Irgalan Yellow 3RL-KWL 250% | .054% |
| Irgalan Black RBL 200% | .204% |

Green Grey

| | |
|---|---|
| Irgalan Yellow 3RL-KWL 250% | .083% |
| Irgalan Bordeaux EL 200% | .022% |
| Irganol Brilliant Blue 7GS 200% | .08% |

Both dyeings were exhaust dyed with 0.25% Irgasol SW and 2.0% MSP to adjust the pH to 6.0. The other two carpets were used as comparisons as conventionally dyed contract carpets. All three carpets were subjected to spotting with staining agents including coffee, cherry Kool-Aid, organic-bound iodine and laundry bleach. Each agent was applied, allowed to remain on the carpet overnight, then cleaned with a water flush.

The carpet of this invention performed in an equal manner to the solution dyed carpet in all areas except resistance to household bleach where the solution dyed carpet was found to be resistant to bleach discoloration whereas the carpet of this invention was not resistant. Conventionally dyed Antron type 856/857 stained heavily.

EXAMPLE 5

Cationic dyeable yarn (Antron type 854) knit into a tube was continuously dyed in a laboratory Ilma pad/steam unit with 100% wet pickup with the indicated premetallized dyes depending upon the shade desired, then steamed for approximately 8 minutes to provide the desired base shade. The base shade-dyed tube was then overprinted using a silk screen process:

Pad baths for the background shade were:

| | | |
|---|---|---|
| Gray: | Irgalan Bordeaux EL | .015% |
| | Irgalan Yellow 3RL | .015% |
| | Irgalan Blue 3GL | .1487% |
| Light Gold: | Irgalan Yellow 3RL | .05% |

Each pad bath also included Celcagum V-60 (0.3%) and Dyebath SS-75 (0.7%) and was adjusted to pH 6 with MSP.

Print pastes in 4 shades were prepared from a base of thickener (Lyngum CP-3) 2.35%, penetrant (Tergitol) 1%, an antifoaming agent (Antifoam CK-2) 0.15% and adjusted to pH 6.0 with MSP. Dyes used for the 4 shades were:

| | |
|---|---|
| dark gold: | Irgalan Yellow 3RL 1% |
| bright blue: | Irganol Brilliant Blue 7GS 0.25% |
| burgundy: | Irgalan Bordeaux EL 200% 1% |
| green: | Irganol Brilliant Blue 7GS 0.25% |
| | Irgalan Yellow 3RL 0.25% |

The printed samples were fixed with steam, washed and dried. The print design was satisfactorily fixed to the nylon tube with good crockfastness. This dyed and space printed product offers a styling versatility advantage over solution dyed nylon, in which pigment is extruded with the polymer, by allowing multiple colors on one yarn while maintaining the antistaining advantage inherent in cationically dyeable nylon yarns.

Additionally a skein of "Antron Lumena" P-807A solution pigmented yarn (colored pigment is incorporated into the polymer prior to extrusion into filament form) which also exhibits cationic dyeable properties, was printed with the same dark gold, bright blue and burgundy formulation above. This was followed by fifteen minutes atmospheric steaming at 210° F., washing and drying. The resulting overprint with the premetallized acid dye was judged to have acceptable crock fastness and performance as a product styling tool.

The following two examples used filament type 634 cationic dyeable dupont nylon, which is twisted into a two ply yarn (4.75 z×4.75 s) and Superba heat-set to retain twist. This yarn was then tufted into a 48 ounce/sq.yd. plush cut pile Saxony carpet.

The carpet was divided into nine 20 gram swatches and dyed for one hour, in dyebaths adjusted for pH (pH 2 to pH 10) with phosphoric acid or tetrasodium phosphate (TSPP), utilizing both a level dyeing acid dye formula and a premetallized acid dye formula for a medium beige shade.

Level Acid Dye Formula:

| | | |
|---|---|---|
| 0.152% | "Tectilon" Yellow 3 RK 200% | Acid Yellow |
| 0.05% | "Tectilon" Red 2B | Acid Red 361 |
| 0.0284% | "Telon" Blue BRL 200% | Acid Blue 324 |

Premetallized Acid Dye Formula:

| | | |
|---|---|---|
| 0.00361% | "Erionyl" Yellow MR 250% | Acid Yellow 151 |
| 0.00106% | "Intralan" Bordeaux 3RS Conc | Acid Red 182 |
| 0.0019% | "Irgalan" Black RBL 200% | Acid Black 132 |

The carpet was dyed from an exhaust bath at 40 to 1 water to goods ratio where the only variable was the pH of the bath. After the dye cycles were complete, the carpet was removed from the bath and rinsed with water. All baths were then adjusted to pH 2.0 with phosphoric acid and a 10 g swatch of deep acid dyeable nylon sock (type 857 Antron) was added to the bath. This procedure scavenged the remaining dyes and permitted estimation of the percent exhaustion of dye by the carpet values.

The carpet swatches were then laid out in a display ranging from pH 2 up to pH 10. The deep acid dyeable sock which exhausted any dyestuff remaining in the respective bath was arranged above the carpet. A visual judgement was made estimating the degree of exhaust obtained at each pH value. Results are found in Table I, and the results of dyeing in the presence of 2% Glauber's salt are shown in Table II. These data are represented graphically in FIG. 1.

TABLE I

| Level Acid Dye | | Premetallized Dye | |
|---|---|---|---|
| pH | Exhaust % | pH | Exhaust % |
| 2 | 80% | 2 | 98% |
| 3 | 40% | 3 | 95% |
| 4 | 30% | 4 | 90% |
| 5 | 30% | 5 | 90% |

TABLE I-continued

| Level Acid Dye | | Premetallized Dye | |
|---|---|---|---|
| pH | Exhaust % | pH | Exhaust % |
| 6 | 30% | 6 | 90% |
| 7 | 25% | 7 | 80% |
| 8 | 20% | 8 | 80% |
| 9 | 20% | 9 | 75% |
| 10 | 40% | 10 | 90% |

TABLE II

| Level Acid Dye + 2% Sodium Sulfate | | Premetallized Dye + 2% Sodium Sulfate | |
|---|---|---|---|
| pH | Exhaust % | pH | Exhaust % |
| 2 | 90% | 2 | 100% |
| 3 | 60% | 3 | 98% |
| 4 | 60% | 4 | 98% |
| 5 | 50% | 5 | 98% |
| 6 | 40% | 6 | 95% |
| 7 | 30% | 7 | 90% |
| 8 | 30% | 8 | 90% |
| 9 | 20% | 9 | 90% |
| 10 | 75% | 10 | 90% |

From these data it will be observed that, in general, metallized acid dyes exhausted much better at all pH values than level dyeing acid dyes on cationic dyeable nylon. The highest degree of exhaust was obtained at acid pH values of less than 7.0 (pH 2.0–7.0) with pH 2.0 showing the highest degree of exhaust. When 2% (on weight of fiber) sodium sulfate (Glauber Salt) was added to the dyebath, better exhaustion was obtained with both dye classes.

It will be apparent from the results presented above that the preferred class of dyes is the premetallized acid dyes with a pH range on the acid side; that is, the pH should be less than 7.0. Sodium sulfate can be used to promote even greater degrees of exhaustion (95% plus) when combined with premetallized acid dyes at pH's of less than 7.0. As a practical matter, pH values of around 2.0 while operable are to be avoided with premetallized acid dyes because of a tendency to demetallize some dyes and the poorer solubility of the dyes in general. These factors are apt to detract from the quality and reproducibility of dyeing.

EXAMPLE 7

The following experiment was conducted to compare the dyeing of cationic dyeable nylon dyed with either an acid dye or a premetallized acid dye over the pH range of 2–10.

Non-heatset cationic dyeable nylon (DuPont Antron) was dyed with two dyes: "Nylanthrene" Blue GLF, an acid dye, and "Irgalan" Black RBL (200%), a premetallized acid dye. Both dyeings employed 0.5% of dye (on the weight of fabric), and were conducted at the following pH values: 2, 4, 6, 6.2, 6.4, 6.6, 6.8, 7.0, 7.3, 7.6, 8 and 10. Phosphoric acid was added to the dyebath to achieve pH 2 and 4; monosodium phosphate for 6.–6.8; distilled water at neutral pH 7; and tetrasodium pyrophosphate at pH 7.3–10. Twelve swatches of 20 grams each of 494 knitted filament nylon sock were dyed from an exhaust bath at a 40 to 1 water to goods ratio in which the only variable was the pH of the bath. The results are shown graphically in Table III.

The light reflections of the dyed knitted socks were then read on the Hunter Lab "Color Quest" 4-inch field spectrophotometer with the pH 7.0 dyeing at neutral pH taken as control. The numerical values recorded were referenced back to the value at neutral pH as darker or lighter. The number used is the Delta L* (lightness/darkness value) from the CIELCH Color Difference equation.

TABLE III

| Premetallized Acid Dye |
|---|
| pH 10.0–3.46 light |
| pH 8.0–2.5 light |
| pH 7.6–3.13 light |
| pH 7.3–2.67 light |
| pH 7.0–Control |
| pH 6.8–0.14 dark |
| pH 6.6–0.55 dark |
| pH 6.4–0.78 dark |
| pH 6.2–2.85 dark |
| pH 6.0–2.30 dark |
| pH 4.0–3.32 dark |
| pH 2.0–5.95 dark |

TABLE IV

| Acid Dye |
|---|
| 4.60 light |
| 3.02 light |
| 1.04 light |
| 0.06 light |
| Control |
| 1.63 dark |
| 1.89 dark |
| 4.83 dark |
| 4.36 dark |
| 5.03 dark |
| 6.70 dark |
| 9.92 dark |

The values are shown in the attached Tables III and IV, respectively, which demonstrate the much better dye exhaust at acid pH values less than 7.0 than at alkaline values above pH 7.0. The amount of dye left in the bath also reflects this difference between an acid pH and an alkaline pH, with the acid bath range 4.0–6.6 causing much less residual color than pH 7.0–8.0.

In the foregoing description, the materials identified for convenience by trade name or trademark are more specifically described in the literature and materials available to the trade as follows:

| Dyestuffs | Color Index Name |
|---|---|
| "Irgalan" Yellow 3RL 200% | Acid Orange 162 |
| "Irgalan" Yellow 3RL 200% (cold water soluble version) | Acid Orange 162 |
| "Irgalan" Red Brown RL 200% | Acid Brown 226 |
| "Irgalan" Bordeaux EL 200% | Acid Red 251 |
| "Irgalan" Blue 3GL 200% | Acid Blue 171 |
| "Irgalan" Black RBL 200% | Acid Black 132 |
| "Irgalan" Black BGL 200% | Acid Black 107 |
| "Irganol" Brilliant Blue 7GS 200% | Acid Blue 239 |
| "Tectilon" Yellow 3RK | Acid Yellow |
| "Tectilon" Red 2B | Acid Red 361 |
| "Telon" Blue BRL 200% | Acid Blue 324 |
| "Erionyl" Yellow MR 250% | Acid Yellow 151 |
| "Intralan" Bordeaux 3RS Conc | Acid Red 182 |
| "Nylanthrene" Blue GLF | Acid Blue |

Chemicals

"Irgasol" SW (Ciba Geigy Corp)—Alkyl Amino Polyglycol Ether. A nonionic aliphatic, nitrogenous compound which complexes with the anionic dye forming addition compounds which break down as temperature rises allowing controlled exhaustion of the dyestuff.

"Progacyl" V-60 VDMIL (Rhone Poulenc) (formerly Celcagum V-60 Lydal Chemical)—Nonionic Guar Gum—a derivatized, low residue, acid hydrating, nondusty guar gum designed specifically for the carpet and textile industries.

"Progacyl" CP-3 (Rhone-Poulenc) (formerly CP3, Lyngum, Lyndal Chemical)—Anionic Guar Gum—An anionic acid hydrating, derivatized guar gum thickener.

"Sedgemul" SS-75 (Sedgefield Specialties) (formerly Dyebath SS-75, BI Chem)—An aqueous mixture of sulfated ether and alcohols—A concentrated anionic wetting agent exhibiting exceptionally rapid wetting properties at temperatures usually employed in textile processing.

"Sedgekil" CK-2 (Sedgefield Specialties) (formerly Antifoam CK-2, BI Chem)—An aqueous mixture of organosilicone, surfactants and acrylic polymer.

"Tergitol" Nonionic 15-S-3 (Union Carbide Corp)—A linear alcohol polyethylene glycol ether.

EXAMPLE 8

Screen printed stain resistant nylon carpet was prepared by printing cationic dyeable carpets previously dyed according to Example 6 to base shades of using the premetallized acid dye formula at pH 6.0 and the level acid dye formula at pH 2.0.

Print pastes were prepared at a concentration of 2.5 grams per liter of each of the following dyes:

| | |
|---|---|
| Erionyl Yellow MR 250% | Ciba Geigy |
| Intralan Yellow 2 BRL-SM | Crompton & Knowles |
| Intralan Bordeaux 3RS Conc. | Crompton & Knowles |
| Intralan Red 2G - 200% | Crompton & Knowles |
| Irgalan Black RBL - 200% | Ciba Geigy |
| Irgalan Blue 3GL - 200% | Ciba Geigy |
| Nylanthrene Blue GLF | Crompton & Knowles |

The print past base was prepared from the following formulation to make one liter of print paste:

| | gram/liter |
|---|---|
| gum thickener (V-60 guar gum) | 6 |
| dye solubilizer (Kromfax) | 3 |
| surfactant (Tergitol) | 10 |
| antifoam agent (CK-2) | 1.5 |
| buffer (MSP) | 2 |
| dye (as above) | 2.5 |

The dye solubilizer Kromfax allows for dye solubility, Tergitol acts as a screen release agent, antifoam CK-2 prevents bubbles in the print paste and monosodium phosphate (MSP) is used to adjust the pH of the paste. This formulation provided a print paste of pH 5.8 and a viscosity of 1,100 to 1,500 cps.

The dyes were each weighed, mixed with 250 ml water, and brought to a boil to dissolve. Kromfax was then added to the hot dye solution to improve dye solubility.

In a separate procedure, the gum was weighed as a dry powder, added to 700 ml water and evenly dispersed with a mixer. MSP buffer was added which started hydration of the gum. After the gum was thickened, the remaining print paste components were added and finally the previously prepared dye solution.

The print pastes thus prepared were applied to "Mint Condition" —Pattern DL-356, a 43 oz. 1/10 gauge cut pile carpet; 13.1 stitches per inch, 0.250 inch pile height. Face fiber yarn DuPont "Antron" Staple, type 971 (cationic dyeable polymer).

Printing Procedure: the print screen was placed on top of dry carpet. Print paste was applied to the screen and stroked twice with a rubber hand squeege to press the dye paste through the screen and onto the carpet. The printed carpet was steamed (212° F. saturated steam for 8 minutes) to fix the dyes. The carpet was then washed and dried. The design was a series of diagonal dots (½ in. in diameter).

In this manner all seven of the individual dyes were printed in self shades on the respective base shades.

EXAMPLE 9

In a separate experiment, using a laboratory sample screen printer, one square yard samples of the carpet construction from Example 8 were printed in a flowing leaf/floral type design.

The carpet was wet-out in a water solution containing wetting agent and squeezed between two nip rolls to approximately 70–100% wet pick up.

On the pre-wet carpet, screens 2 through 8 were printed with their respective print pastes. The print was made on a laboratory flat screen print table, with electromagnets providing the pressure for the transport and downward force. Each screen received a forward and back stroke.

Following the printing of screens 2 through 8, a flood shade was applied at 300% wet pick up. The flood shade provided color penetration to the base of the tufts. Goods were transported in a horizontal position through all of the color application steps to maintain as distinct a pattern as possible.

Steaming for 8 minutes (saturated steam, 210°–212° F.) in a horizontal position provided fixation of the color. Following steaming, the carpet was washed and dried.

| | |
|---|---|
| Chemical Formulation: | Wetout: (70%–100% wet pickup) |
| | 1.0 gram/liter Acid Buffer (pH 5.5 ± 0.5) |
| | 2.0 grams/liter NI 100 (Sequestering Agent for hard water) |
| | 2.0 grams/liter Amquwet (Nonionic wetting agent) |
| | 3.0 grams/liter Kromfax |
| Print Paste: | 11.0 grams/liter Guar Gum (5000 centipoise viscosity) |
| | 1.0 gram/liter Defoamer |
| | 1.5 grams/liter Acid Buffer (pH 5.5 ± 0.5) |
| | 3.0 grams/liter Kromfax - Thiodiglycol dye solubilizer |
| Flood Shade: | 2.0 grams/liter Guar Gum (20 centipoise viscosity) |
| | 2.0 grams/liter Amquwet (Nonionic wetter) |
| | 3.0 grams/liter Kromfax |
| | 2.0 grams/liter NI 100 (Sequestering Agent) |
| | 1.5 grams/liter Acid Buffer (pH 5.5 ± 0.5) |

The quality of the prints, using premetallized acid dyes, from a pattern clarity and penetration standpoint, was very satisfactory. Fastness tests are also satisfactory.

Although flat screen printing was used in this particular example, other printing methods known in this art including rotary screen and jet printing of cationic dyeable nylon filament and staple at pHs in the range of 1.8 to 7.0, preferably 2.0 to 6.8, are within the scope of this embodiment of the invention.

What is claimed:

1. A process of preparing a stain-resistant, lightfast nylon carpet comprising the steps of:

(a) dyeing cationic-dyeable nylon fibers by applying to said fibers a print paste containing an acid dye or a premetallized acid dye at a pH of from about 2.0 to about 6.5 and fixing the dye to the fibers, (b) forming the then printed nylon fibers into a carpet, (c) applying to the dyed nylon carpet a print paste containing an acid dye or premetallized acid dye and dyeing the nylon fibers contacted with the print paste; and thereafter (d) heating the dye-laden fibers to fix the dye into the fibers.

2. The process of claim 1, in which the nylon fibers contain $SO_3H$ or COOH or both $SO_3H$ and COOH groups receptive to cationic or basic dyes in an amount sufficient to render the cationic fiber dyeable with a cationic or basic dye.

3. The process of claim 1 in which the nylon fibers are dyed at a pH of from about 4.0 to about 6.5.

4. The process of claim 1 in which, subsequent to dye fixation of step (d), a fluorocarbon repellant is applied to the fibers.

5. The process of claim 1 in which sodium sulfate is also present in the print paste of step (a), step (c) or both.

6. A process of preparing a stain resistant, multicolored, cationic dyeable nylon yarn comprising the successive steps of (a) applying to a cationic dyeable nylon yarn a print paste containing an acid dye at a pH of about 2.0 to less than 6.5 and fixing the acid dye to the yarn to produce a desired base shade; and (b) overprinting the dyed cationic dyeable yarn of step (a) by applying a print paste containing an acid dye or a premetallized acid dye to produce a multicolored stain-resistant nylon yarn.

7. A process of preparing a stain resistant, multicolored, cationic dyeable nylon yarn comprising the successive steps of (a) applying to a cationic dyeable nylon yarn a print paste containing a premetallized acid dye at a pH of about 2.0 to less than 6.5 and fixing the premetallized acid dye to the yarn to produce a desired base shade, (b) overprinting the dyed cationic dyeable yarn of step (a) by applying a print paste containing an acid dye or a premetallized acid dye to produce a multicolored stain-resistant nylon yarn.

8. A process of preparing stain-resistant, lightfast nylon yarn comprising printing cationic-dyeable yarn with a premetallized acid dye at a pH of about 4.0 to less than about 6.5 and fixing the dye to the yarn.

9. The process of claim 8 in which the nylon yarn contains $SO_3H$ groups or COOH groups or both $SO_3H$ and COOH groups receptive to cationic or basic dyes in an amount sufficient to render the cationic fiber dyeable with a cationic or basic dye.

10. The process of claim 9 in which the nylon yarn contains COOH groups.

11. A process of dyeing heatset cationic-dyeable nylon yarn comprising printing said yarn with a premetallized acid dye at a pH of from about 2.0 to less than about 6.5 and fixing the dye to the yarn.

12. A process of preparing a stain-resistant, lightfast nylon yarn comprising printing heatset cationic-dyeable nylon yarn with a premetallized acid dye at a pH of from about 2.0 to less than about 6.5 to dye the nylon yarn and heating the dye-laden yarn to fix the dye into the yarn.

13. The process of claim 11 or 12 in which the nylon yarn contains $SO_3H$ or COOH or both $SO_3H$ and COOH groups receptive to cationic or basic dyes in an amount sufficient to render the cationic yarn dyeable with a cationic or basic dye.

14. The process of claim 11 or 12 in which the nylon yarn is dyed at a pH of from about 4.0 to about 6.0.

15. The process of claim 11 or 12 in which, subsequent to dye fixation, a fluorocarbon repellant is applied to the yarn.

16. The process of dyeing 100% cationic dyeable nylon yarn comprising applying to said yarn a print paste containing at least one acid dye and devoid of cationic dyes at a pH of from about 2.0 to less than about 6.5 and fixing the dye to the cationic dyeable yarn.

17. A process of preparing a stain-resistant, lightfast nylon yarn comprising printing cationic-dyeable nylon yarn with an acid dye at a pH of from about 2.0 to less than about 6.5 to impart the requisite depth of shade to the nylon yarn and heating the dye-laden yarn to fix the dye into the yarn.

18. The process of claim 16 or 17 in which the nylon yarn contains $SO_3H$ or COOH groups or both $SO_3H$ and COOH groups receptive to cationic or basic dyes in an amount sufficient to render the cationic yarn dyeable with a cationic or basic dye.

19. The process of claim 16 or 17 in which the nylon yarn is dyed at a pH of from about 4.0 to about 6.5.

20. The process of claim 16 or 17, in which, subsequent to dye fixation, a fluorocarbon repellant is applied to the yarn.

21. The process of claim 16 or 17 in which sodium sulfate is also present in the print paste.

* * * * *